United States Patent [19]

Davis

[11] Patent Number: 4,492,126

[45] Date of Patent: Jan. 8, 1985

[54] VARIABLE LEVERAGE OIL FIELD PUMP JACK

[76] Inventor: C. Arthur Davis, P.O. Box 2114, Ada, Okla. 78420

[21] Appl. No.: 378,509

[22] Filed: May 17, 1982

[51] Int. Cl.[3] ..... F16H 21/32

[52] U.S. Cl. ..... 74/41; 74/43; 74/96; 74/590

[58] Field of Search ..... 74/41, 43, 96, 590, 74/591, 589

[56] References Cited

U.S. PATENT DOCUMENTS

| | | | |
|---|---|---|---|
| 542,646 | 7/1895 | Jones et al. | 74/590 X |
| 1,417,604 | 5/1922 | Jamison | 74/43 |
| 1,564,320 | 12/1925 | Callahan | 74/590 X |
| 2,148,516 | 2/1939 | Thompson | 74/41 |
| 2,184,437 | 12/1939 | Saxe | 74/589 X |
| 2,526,561 | 10/1950 | Keltner | 74/41 X |
| 3,016,767 | 1/1962 | Egan et al. | 74/589 |
| 3,094,879 | 6/1963 | Eaton | 74/41 |
| 3,136,166 | 6/1964 | Journey | 74/41 |
| 3,222,940 | 12/1965 | Chastain | 74/41 |
| 3,371,554 | 3/1968 | McCray et al. | 74/41 |
| 4,238,966 | 12/1980 | Carlson et al. | 74/41 |
| 4,321,837 | 3/1982 | Grigsby | 74/591 X |
| 4,354,395 | 10/1982 | Page, Jr. | 74/41 |

*Primary Examiner*—Rodney H. Bonck
*Assistant Examiner*—David D. House
*Attorney, Agent, or Firm*—Allen A. Dicke, Jr.

[57] ABSTRACT

In a heavy-duty pump jack as used in oil well pumping, a leverage beam is oscillated by a motor-driven crank and the leverage beam acts upon the walking beam through an adjustable stroke controller.

19 Claims, 2 Drawing Figures

VARIABLE LEVERAGE OIL FIELD PUMP JACK

BACKGROUND

This invention is directed to a heavy-duty pump jack of the type used in oil well pumping. The pump jack eliminates the usual gear box by employing belt-driven speed reduction and leverage for force multiplication.

The modern oilfield pump jack employs a prime mover such as an electric motor or internal combustion engine as its primary power source. The rotary prime mover is connected to a gear box with an output crank. The gear box reduces the speed and multiplies the torque so that the crank can be coupled through a connecting rod directly to the walking beam. The walking beam carries a horse head from which the pump string depends. Counter weights are applied to the walking beam and/or the crank to attempt to equalize the load on the prime mover.

The modern demand for pumping units has outstripped the supply of gear boxes. As a result, there are wells which could usefully employ a pump jack, but gearboxes are not available for pump jacks for those wells. Consequently, there is need for oil well pump jacks which do not employ a gear box.

SUMMARY

In order to aid in the understanding of this invention, it can be stated in essentially summary form that it is directed to a leverage pump jack wherein a pivotal walking beam is rocked by a lever, and the lever is oscillated by an electric motor driving a crank through a belt reduction. The lever provides force multiplication.

It is, thus, an object of this invention to provide a leverage pump jack which provides the necessary force for pumping without the employment of a gear box. It is a further object to provide a leverage pump jack wherein a leverage beam acts upon the walking beam to multiply the pumping force and reduce pumping stroke, with the leverage beam being oscillated by a crank. It is a further object to provide a leverage pump jack which has adjustability in the interaction between the leverage beam and the walking beam so that adjustment may be made without reconstruction. It is a further object to provide a weight which is picked up by the leverage beam when the walking beam is adjacent its bottom end so that the weight helps counterbalance deceleration at the bottom of the hole.

Other objects and advantages of this invention will become apparent from a study of the following portion of the specification, the claims and the attached drawings.

DESCRIPTION OF THE PREFERRED EMBODIMENT

Figure 1:
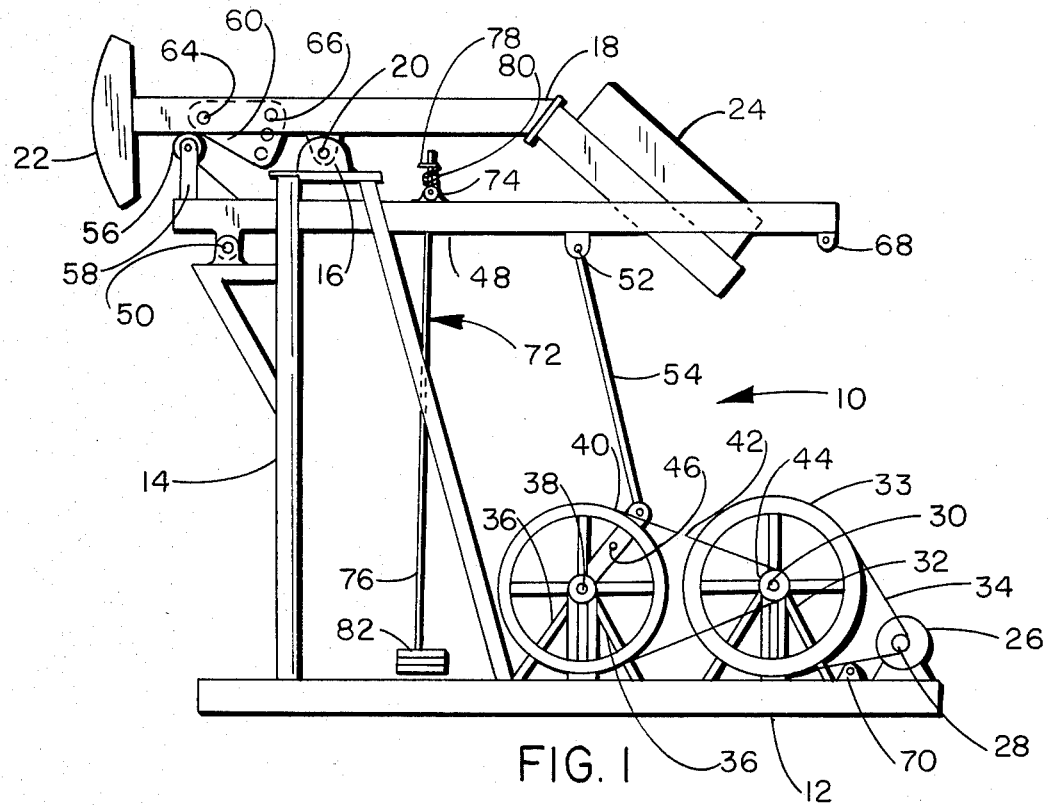
FIG. 1 is a side-elevational view of the leverage pump jack of this invention with the horse head almost in its lowest position.
Figure 2:
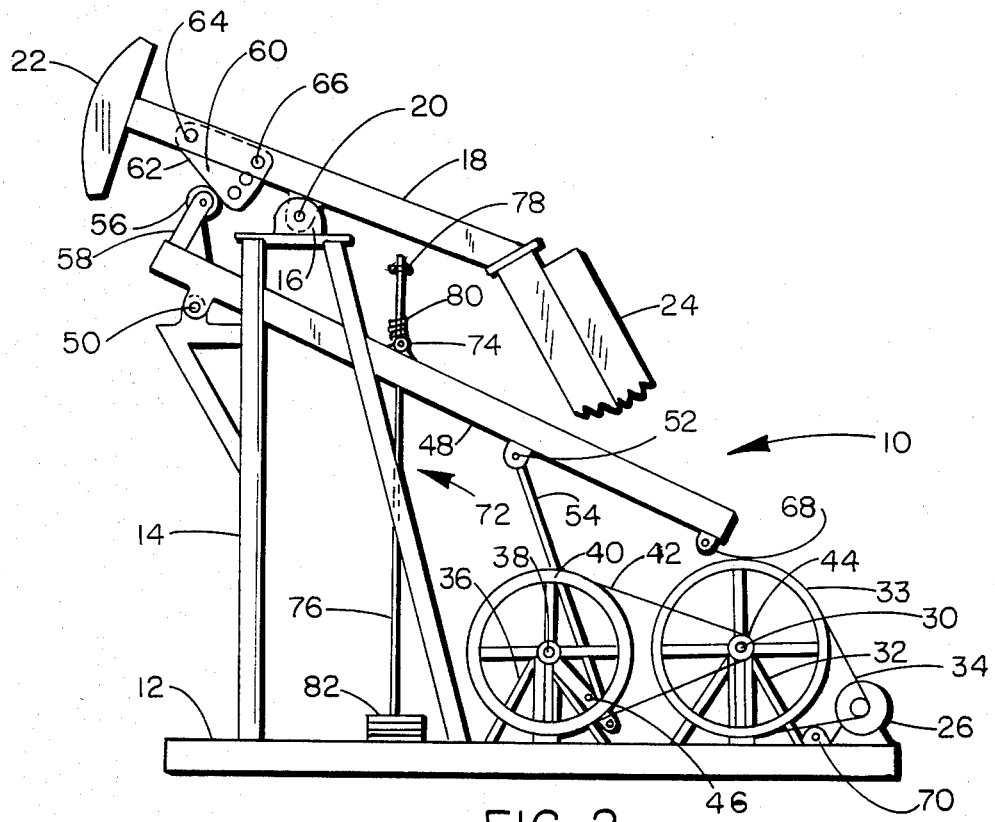
FIG. 2 is a similar view, showing the horse head in almost its highest position.

The leverage pump jack of this invention is generally indicated at 10 in FIGS. 1 and 2. Base 12 is mounted on the ground or on a suitable foundation adjacent the well to be pumped. Sampson post 14 extends upwardly from base 12 and carries beam bearing 16 at its top. Walking beam 18 is mounted on pivot pin 20 for rotary oscillating motion on the pivot pin axis. Horse head 22 is fixedly mounted on the outer end of walking beam 18. Balance weight 24 of selectable size is mounted on the other end of the walking beam to counterbalance the rod string and the movable parts of the pump down hole in the well. By rocking walking beam 18 on its pivot pin 20, the down hole pump is operated.

Pump jack 10 is capable of producing pumping forces in wells of moderate size with a fairly small prime mover. Thus, the prime mover can be of moderate size. An electric motor 26 is illustrated. Electric motor 26 has a Vee belt pulley or sheave 28 as its mechanical output. Countershaft 30 is rotatably mounted on a suitable bearing support 32. Sheave 33 is fixedly mounted on countershaft 30 and is driven from sheave 28 by belt 34. Adjacent to bearing support 32 is bearing support 36 which rotatably carries shaft 38. Sheave 40 is driven by belt 42 which also engages over sheave 44 which is fixed on shaft 30, together with sheave 33. These sheaves and belts are preferably Vee belts because of the superior transmission capability in small space. If required, multiple parallel belts can be employed. Crank 46 is fixed to shaft 38 and rotates therewith.

Oscillation of walking beam 18 by motor 26 is accomplished by leverage beam 48 interconnected therebetween. Leverage beam 48 is pivotably mounted on leverage bearing 50 which is mounted on Sampson post 14. Leverage bearing 50 has its pivotal axis parallel to the axis of pivot pin 20 so that leverage beam 48 is mounted below walking beam 18. Wrist pin 52 is secured on the underside of leverage beam 48. Connecting rod 54 interconnects crank 46 with the wrist pin so that the leverage beam oscillates on the axis of its bearing 50 when the crank rotates. The throw of crank 46 may be adjustable, either by means of a sliding connecting rod bearing thereon, to change the effective radius, or by several discrete connecting rod bearing fastening devices thereon. Thus, the total oscillatory stroke angle of the leverage beam can be adjusted. As far as oscillatory rate is concerned, the sheaves 28 and 44 can be between 3 and 4 inches in diameter, and the large sheaves 33 and 40 can be up to 36 inches in diameter. With a motor 26 having a full-load speed of 1,100 rpm, by sheave size selection one can achieve a pumping frequency as low as about 8 cycles per minutes. A pumping frequency in the order of 16 cycles per minute is more usual in the size of the structure presently contemplated. Thus, a sufficiently low pumping speed is achievable.

Drive roller 56 is mounted on the outer end of the leverage beam, on the opposite side of bearing 50 from wrist pin 52. Post 58 supports drive roller 56 above the leverage beam 48 both for geometrical purposes and to provide the clearances necessary for the leverage beam to pass through the open center of Sampson post 14 below walking beam bearing 16. Drive plate 60 has a straight lower edge 62, as is illustrated, and is mounted on pivot 64 towards the outer end of walking beam 18. Drive plate 60 is positioned so that when the walking beam 18 and leverage beam 48 are in their most counter clockwise position, close to that shown in FIG. 1, drive roller 56 bears on the lower side of walking beam 18 just to the left of drive plate 60. When leverage beam 48 is moved in the clockwise direction, as shown in FIG. 2, where the beam is almost to its limit position, drive roller 56 rolls up the edge 62 of drive plate 60 to force the walking beam 18 in the clockwise direction, as illustrated.

Lock pin 66 is shown as extending through the walking beam and through the uppermost hole in drive plate 60. There are other holes in drive plate 60, and the lower holes can be selected for other drive kinematics. With the position of the drive plate illustrated in FIG. 2, the kinematic motion can be visualized. With the pin 66 in the lowermost hole, the drive roller 56 would be following the lower surface of walking beam 18 so that less stroke is achieved. Thus, the edge 62 both by its curvature and its angle determine the kinematics. For convenience, a straight edge 16 is shown, although other shapes can be designed to control the acceleration and motor loads at various parts of the stroke.

FIG. 1 illustrates the pump jack nearly in its most counter-clockwise position. In this position, the drive roller 56 bears against the lower surface of walking beam 18 so that the angle of the drive plate 60 can be adjusted without any load thereon. Eyes 68 and 70 are respectively provided at the outer end of leverage beam 48 and base 12 so that a chain, cable or chain hoist may be secured therebetween to support the load on horse head 22 when the balance weight 24 is changed or other structure on the pump jack is being adjusted.

Deceleration of the pump jack and the down hole equipment towards the end of the downwad stroke is often a critical point of the cycle because the weight of the down hole equipment and the deceleration forces are acting in the same direction. Stroke bottom system 72 is employed to add a counterbalancing force at the lower end of the stroke. Cross pin 74 is pivotably mounted on leverage beam 48. It has a cross hole, positioned in the upright direction, through which weight rod 76 extends. Cap 78 is secured to the top of weight rod 76. Compression spring 80 embraces weight rod 76 and is positioned above cross pin 74 and below cap 78. Weights 82, of a selectable total weight, are secured to the bottom of weight rod 76. The length of the weight rod is such that when leverage beam 48 has the walking beam and cross head 22 in the raised position shown in FIG. 2, the weights 82 rest upon base 80. When the rocking structure moves towards the lowermost position of the moving down hole equipment, cross pin 74 rises to the point where spring 80 is engaged and weights 82 are lifted. The position of cap 78 on the weight rod controls the point at which the weights 82 are raised. Thus, adjustment of the cap position and adjustment of the total value of weights 82 helps equalize the load on motor 26 as the pump jack goes through its oscillation cycle. Adjustment of drive plate 60 and the radius of crank 46 control the amount of stroke. Both can be adjusted without large equipment or large work force. The use of leverage beam 48 multiplies the available force and permits the modification of the cyclic kinematics through the adjustment of drive plate 60 and permits the varying of the motor load by adjustment of the stroke bottom system 72.

This invention has been described in its presently contemplated best mode, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A pump jack comprising:

a post;

a walking beam pivotably mounted on said post for oscillating on its pivot with respect to said post, roller engagement means on said walking beam away from its pivot, said walking beam having means thereon for connection to pumping equipment;

a leverage beam pivotably mounted with respect to said post, said leverage beam having a roller rotatably mounted thereon on a fixed rotational axis during operation for engaging said walking beam for urging said walking beam to rotate upon its pivot; and a crank connected to said leverage beam for oscillating said leverage beam when said crank is turned so that rotation of said crank causes oscillation of said leverage beam which, in turn, causes oscillation of said walking beam to produce pumping motion.

2. The pump jack of claim 1 wherein said walking beam has a drive plate thereon and said roller engages on said drive plate as said walking beam oscillates.

3. The pump jack of claim 2 wherein said drive plate is adjustably secured on said walking beam so that adjustment of said drive plate with respect to said walking beam changes the system kinematics.

4. The leverage pump jack of claim 1 wherein a rotary prime mover is connected through a belt reduction system to rotate said crank.

5. The pump jack of claim 4 wherein said belt reduction system includes a double reduction system wherein a counter shaft carries a large sheave which is belt-driven by said motor and carries a small sheave which belt-drives a second large sheave which is connected to said crank to rotate said crank.

6. A pump jack comprising:

a post;

a walking beam pivotably mounted on said post for oscillating on its pivot with respect to said post, said walking beam having means thereon for connection to pumping equipment;

a leverage beam pivotably mounted with respect to said post, said leverage beam having engagement means thereon for engaging said walking beam for urging said walking beam to rotate on its pivot;

a crank connected to said leverage beam for oscillating said leverage beam when said crank is turned so that rotation of said crank causes oscillation of said leverage beam which, in turn, causes oscillation of said walking beam to produce pumping motion; and a stroke bottom system connected to said leverage beam, said stroke bottom system including a cross pin mounted on said leverage beam, said cross pin having an opening therethrough, a weight rod extending through said opening, a stop on said weight rod above said cross pin and a compression spring engaged around said weight rod between said cross pin and said stop and a weight secured to said weight rod below said cross pin so that said weight is lifted only when said walking beam is adjacent its stroke bottom position.

7. The pump jack of claim 6 wherein said engagement means is a roller mounted on one of said beams for rolling contact with respect to the other of said beams.

8. The pump jack of claim 7 wherein said beam not having said roller has a drive plate thereon and said roller engages on said drive plate as said walking beam oscillates.

9. The pump jack of claim 8 wherein said drive plate is adjustably secured on said beam so that adjustment of said drive plate with respect to said beam changes the system kinematics.

10. A pump jack comprising:

a base;

a leverage bearing mounted on said base;

a leverage beam pivotably mounted on said leverage bearing for rotation around said leverage bearing;

a crank rotatably mounted on said base, a connecting rod connected between said crank and said leverage beam so that as said crank rotates with respect to said base, said leverage beam oscillates around said leverage bearing;

a beam bearing mounted with respect to said base;

a walking beam pivotably mounted on said beam bearing for oscillating on its bearing, said walking beam having means thereon for connection to pumping equipment;

a drive roller on one of said beams and a roller engagement surface on the other of said beams so that as said crank rotates and said leverage beam oscillates, said roller and said roller engagement surface interengage to oscillate said walking beam on its pivot.

11. The pump jack of claim 10 wherein the pivot axis of said roller with respect to the leverage beam and each of the pivot points is fixed during cycle operation.

12. The pump jack of claim 10 wherein said engagement surface against which said drive roller engages is adjustably mounted with respect to the beam on which it is mounted.

13. The pump jack of claim 12 wherein said engagement surface is mounted on said walking beam and said drive roller is mounted on said leverage beam.

14. The pump jack of claim 10 wherein the pivot point of said walking beam is fixed with respect to said walking beam, the pivot point of said leverage beam and the pivot point of said connecting rod on said leverage beam are fixed with respect to said leverage beam during cycle operation.

15. The pump jack of claim 14 wherein the pivot point of said drive roller is fixed with respect to the beam on which it is mounted during cycle operation.

16. The pump jack of claim 10 wherein the pivot point of said drive roller is fixed with respect to the beam on which it is mounted during cycle operation.

17. The pump jack of claim 16 wherein said engagement surface against which said drive roller acts is fixed on its beam during cycle operation.

18. The pump jack of claim 17 wherein said engagement surface against which said drive roller engages is adjustably mounted with respect to the beam on which it is mounted.

19. The pump jack of claim 18 wherein said engagement surface is mounted on said walking beam and said drive roller is mounted on said leverage beam.

* * * * *